US009008838B2

(12) United States Patent
Geidek

(10) Patent No.: US 9,008,838 B2
(45) Date of Patent: Apr. 14, 2015

(54) DEVICE FOR TESTING AND/OR OPERATING AN EFFECTOR UNIT

(71) Applicant: MBDA Deutschland GmbH, Schrobenhausen (DE)

(72) Inventor: Franz Geidek, Aresing (DE)

(73) Assignee: MBDA Deutschland GmbH, Schrobenhausen (DE)

( * ) Notice: Subject to any disclaimer, the term of this patent is extended or adjusted under 35 U.S.C. 154(b) by 121 days.

(21) Appl. No.: 13/793,777

(22) Filed: Mar. 11, 2013

(65) Prior Publication Data

US 2013/0268115 A1 Oct. 10, 2013

(30) Foreign Application Priority Data

Mar. 28, 2012 (DE) ..... 10 2012 006 352

(51) Int. Cl.

| | |
|---|---|
| ***G06F 19/00*** | (2011.01) |
| ***G05D 1/10*** | (2006.01) |
| ***F41H 13/00*** | (2006.01) |
| ***F41A 27/28*** | (2006.01) |
| ***F41A 31/00*** | (2006.01) |
| ***F41A 33/00*** | (2006.01) |
| ***F41A 33/02*** | (2006.01) |

(52) U.S. Cl.

CPC ..... *G05D 1/10* (2013.01); *F41H 13/005* (2013.01); *F41A 27/28* (2013.01); *F41A 31/00* (2013.01); *F41A 33/00* (2013.01); *F41A 33/02* (2013.01)

(58) Field of Classification Search

CPC ..... G05B 17/02; G09B 9/05
USPC ..... 219/121; 455/609; 700/245, 259
See application file for complete search history.

(56) References Cited

U.S. PATENT DOCUMENTS

| | | | | |
|---|---|---|---|---|
| 4,764,983 | A * | 8/1988 | Walter | 398/131 |
| 4,798,462 | A | 1/1989 | Byren | |
| 4,954,762 | A * | 9/1990 | Miyake et al. | 318/568.19 |
| 6,369,353 | B1 * | 4/2002 | Soska | 219/121.68 |
| 7,002,127 | B2 | 2/2006 | Billman | |
| 2004/0075884 | A1 | 4/2004 | Byren et al. | |
| 2007/0075055 | A1 * | 4/2007 | Komatsu | 219/121.63 |
| 2008/0035619 | A1 * | 2/2008 | Hamaguchi et al. | 219/121.79 |
| 2011/0301758 | A1 * | 12/2011 | Nakajima et al. | 700/259 |
| 2012/0029703 | A1 * | 2/2012 | Veltena | 700/275 |

FOREIGN PATENT DOCUMENTS

| | | | |
|---|---|---|---|
| DE | 38 17 169 | A1 | 11/1989 |
| DE | 603 13 013 | T2 | 12/2007 |
| DE | 10 2008 023 955 | A1 | 11/2009 |
| DE | 10 2010 053 686 | B3 | 1/2012 |

* cited by examiner

*Primary Examiner* — Jerrah Edwards
*Assistant Examiner* — Tamara Weber
(74) *Attorney, Agent, or Firm* — Crowell & Moring LLP

(57) ABSTRACT

A device for testing and/or operating an effector unit for acting on a target includes a positioner unit for moving the effector unit and a control unit for driving the positioner unit. The control unit is configured to simulate and/or to damp the accelerations of a carrier platform, on which the device can be mounted under real conditions, by means of the positioner unit.

7 Claims, 2 Drawing Sheets

DEVICE FOR TESTING AND/OR OPERATING AN EFFECTOR UNIT

CROSS-REFERENCE TO RELATED APPLICATIONS

Figure 1:
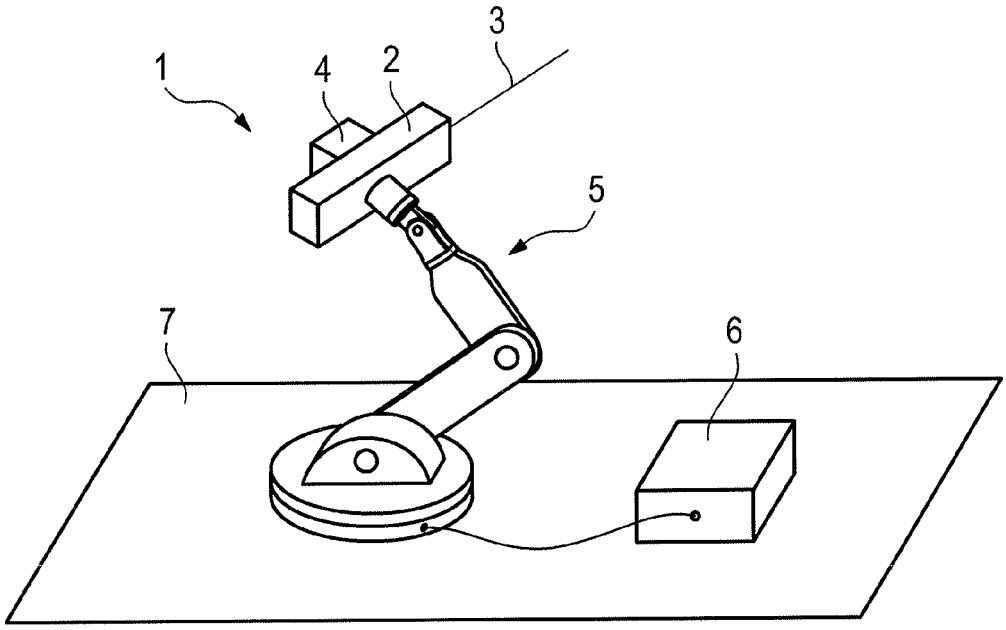

This application claims priority under 35 U.S.C. §119 to German Patent Application No. 10 2012 006 352.0, filed Mar. 28, 2012, the entire disclosure of which is herein expressly incorporated by reference.

BACKGROUND AND SUMMARY OF THE INVENTION

Exemplary embodiments of the present invention relate to a device for operating and, in particular, also for testing an effector unit. In particular, exemplary embodiments of the present invention relate to a device for damping, preferably also for simulating, the movements of a carrier platform, on which the effector unit can be mounted under real conditions.

Laser weapon systems are often employed in order to defend against the threat of airborne weapons, such as grenades or missiles. A laser weapon system can act on a target by pointing a high energy laser beam at the target. When the target absorbs the laser beam, it heats up, which results in a defense against the target.

Such laser weapon systems are usually mounted on a larger carrier platform, such as a vehicle, a ship or in an aircraft. However, such an arrangement faces many challenges with respect to operating the laser weapon system. First, any disturbance, which is based on a movement of the carrier platform, such as the rolling of a ship at high seas, has to be counteracted. Second, the laser weapon system has to be aimed at a target to be engaged and has to track the movement of the target. It goes without saying that such requirements need complex control systems in order to guarantee a safe and reliable operation of the laser weapon system.

To date new control strategies as well as new methods for detecting and tracking a target to be hit, for example, using optical image processing, have been tested directly on a real system on a real platform. These tests, however, are time consuming and cost intensive, a feature that represents a major drawback in the development of laser weapon systems.

Exemplary embodiments of the present invention provide a device that is cost effective and requires little effort to manufacture and that enables a safe and nearly maintenance free operation of effector systems.

Exemplary embodiments of the present invention are directed to a device for operating, and preferably also for testing, an effector unit for acting on a target, wherein the device comprises a positioner unit and a control unit. In this case the effector unit is mounted on the positioner unit in such a way that the positioner unit can move the effector unit. The control unit is connected to the positioner unit and serves to drive the positioner unit by specifying the movements.

The control unit is configured to damp accelerations and the resulting velocities and movements of a real carrier platform by means of the positioner unit. As a result, the device can be used as a carrier system, which is mounted on the carrier platform, for the effector unit under operating conditions. The damping effect protects the effector unit against large accelerations generated by the carrier platform. Therefore, according to the invention it is possible to use an effector unit that has, for example, a high precision mechanism for aiming at the target to be hit and that would otherwise be adversely affected by the accelerations transferred from the carrier platform.

Furthermore, the control unit is configured preferably to simulate the accelerations of a carrier platform by means of the positioner unit. Since the effector unit can be mounted on a carrier platform under real conditions, the effector unit is always exposed to the disturbing accelerations of the carrier platform under real conditions. With the device according to the invention these accelerations can be simulated by the positioner unit. Hence, it is no longer necessary to mount the effector unit on a real platform just to test new control approaches. As a result, both the time and the financial layout for testing effector units are significantly reduced. Yet it is possible to test the effector unit under conditions that meet or at least come very close to the real conditions.

The device can include a recognition unit, with which the target to be hit can be detected. The recognition unit is also connected to the control unit, so that the control unit can point the effector unit at the detected target by means of the positioner unit, in order to act on the target. For example, the recognition unit can be a camera, with which the airborne targets can be recognized and captured. In addition, it is possible for the effector unit to be configured in such a way that the effect is adjusted, as determined by the control unit, on the basis of the movement of the target, in particular, at a high frequency.

In accordance with one aspect of the present invention the positioner unit has at least three rotatory and/or at least three translatory degrees of freedom. In particular, the positioner unit can move the effector unit in any arbitrary spatial direction and into any arbitrary position. Hence, it is possible to produce a very precise simulation of the movements of the carrier platform, so that an effector unit can be tested under real conditions and approximately real conditions.

The control unit can be configured in such a way that it actuates the positioner unit in such a way that the effector unit is pointed at the target to be hit. Furthermore, the control unit can be configured in such a way that, after the effector unit has been pointed at the target, the effector unit is automatically readjusted on the basis of the target, so that the effector unit continues to remain pointed at the target. Only in this way is it possible to act effectively on the target.

Furthermore, the control unit can be configured to compensate for the real movements, and preferably also the simulated movements, of the carrier platform by means of the positioner unit. As a result, influences of the carrier platform on the accuracy of the target tracking and/or the target engagement can be minimized. Due to this stabilization of the movements of the carrier platform, the effector unit remains ideally stationary at one spot and can, therefore, be used at any time to act on a recognized target.

In accordance with one aspect of the present invention the effector unit comprises a laser. A laser has proven to be useful predominantly for acting on airborne targets, because, for example, no lead angle has to be observed.

In accordance with another aspect of the present invention the positioner unit comprises an industrial robot. In particular, an industrial robot with six axes. Therefore, this industrial robot is able to maneuver the effector unit into any and all possible spatial positions or locations within the working space of the industrial robot. In addition, industrial robots are more advantageous than special designs or real carrier platforms that would be needed to move the effector unit.

Furthermore, the invention relates to a method for operating, and preferably also for testing, an effector unit for acting on a target by means of the aforementioned device. To this end, three or four different programs, each of which has a different task, are run on the control unit as a function of the special application. In the case of a simulation mode a first program on the control unit serves to simulate the movements of the carrier platform; and a second program on the control unit serves to damp and/or stabilize these simulated movements of the carrier platform. If the device according to the invention is used to operate the effector unit, then only the second program that stabilizes and/or damps the movements of a real carrier platform is used. In both cases a third program serves to detect and track the target; and a fourth program serves to aim the effector unit at the detected target. With the first special application of the method, which is provided in an advantageous embodiment of the invention, it is possible, for example, to test new controllers that are intended to stabilize the movement of the carrier platform. New methods for detecting and tracking the target can be tested just as well. However, in order to conduct these tests, the device according to the invention does not have to be mounted on a real carrier platform, but rather can be fastened, for example, on a simple base. Yet it is possible to generate conditions that match or at least closely resemble the real conditions. With the second special application of the method that is provided according to the invention, the effector unit is operated under real conditions. In the event of imminent shock loads that can be transferred to the effector unit from the carrier platform, the positioner unit damps this load and/or stabilizes the movements of the carrier platform.

The method according to the invention is carried out in an advantageous way in that the following steps are performed one after the other in succession. To begin with, a first variant of the first, second, third and/or fourth program is run on the control unit. The first variant serves, for example, as a reference variant for testing new programs. Then a target is acted upon and the energetic effect of the action is measured. This first action can be used, just as well, for example, as a reference value, in order to check the efficiency of the new programs for the control unit. Therefore, in a third step the first variant of the first, second, third and/or fourth program on the control unit is exchanged for a second variant. Then a second action is performed on the target and once again the energetic effect of the action is measured. Thus, at this point the measurement results of the first action and the measurement results of the second action now stand opposite each other. Therefore, in a third step the measurement of the first action is compared with the measurement of the second action. This arrangement makes it possible to unequivocally determine whether the second variant of a program achieves a better effect than the first variant. In addition, it is also evident that a plurality of programs can be tested with this method without having to conduct cost intensive and time consuming tests on real carrier platforms.

The method according to the invention is carried out in a preferred way in that the effector unit acts on a target and the movement of the target is simulated by a target simulator. The use of a target simulator means that costly firing tests with real flying objects do not have to be carried out. As a result, the efficiency of the test of effector units is further increased. The target simulator can simulate, for example, the characteristic movements that occur in the course of the flight of a real grenade, so that real flight tests do not have to be conducted in order to test the effector unit.

BRIEF DESCRIPTION OF THE DRAWING FIGURES

Figure 2:
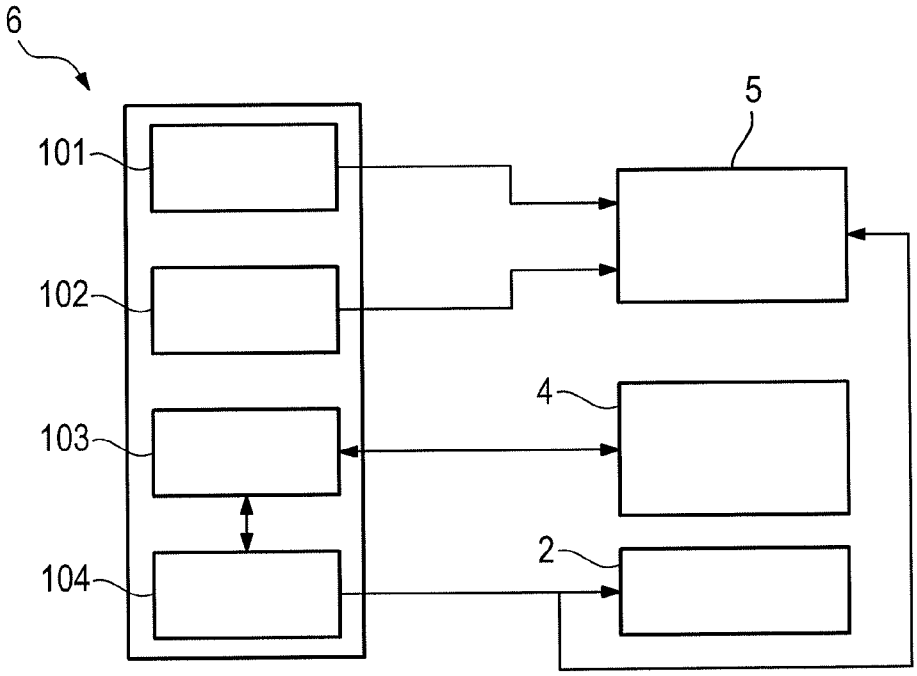
Figure 3:
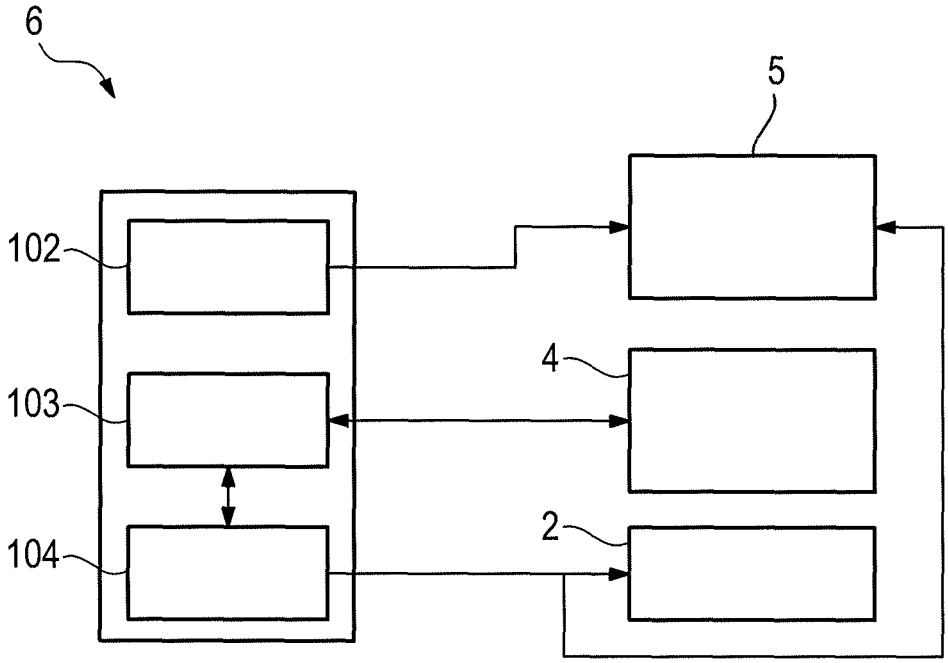

The invention is explained in detail below by means of a preferred exemplary embodiment with reference to the accompanying figures. Referring to the drawings:

FIG. 1 is a schematic view of an inventive device for testing an effector unit according to all of the preferred exemplary embodiments of the invention; and FIG. 2 is a schematic view of the construction of the control unit of the inventive device according to a first preferred exemplary embodiment of the invention; and FIG. 3 is a schematic view of the construction of the control unit of the inventive device according to a second preferred exemplary embodiment of the invention.

DETAILED DESCRIPTION

FIG. 1 shows a device 1 for testing and/or operating an effector unit 2. In this case the effector unit is a laser weapon system that emits a laser beam 3. The laser beam 3 serves to engage a target, which can be simulated target or a real target. In addition, the effector unit can have a recognition unit 4, with which potential targets are recognized. The recognition unit 4 serves to detect the flight path of the target and to readjust the effector unit 2, so that the laser beam 3 remains constantly aimed at the detected target. The pointing and readjustment of the effector unit is performed by way of a positioner unit 5, which comprises an industrial robot with six axes in this example. Therefore, it is possible for the positioner unit 5 to maneuver the effector unit 2 into any arbitrary spatial location and into any arbitrary spatial position within a working range of the positioner unit 5.

The positioner unit 5 is mounted on a base 7 and is connected to a control unit 6. The control unit 6 serves to initiate a movement of the positioner unit 5 and coordinates the detection of a target by way of the recognition unit 4 and coordinates the pointing of the effector unit 2 at a recognized target. Since the base 7 is a solid and immovable foundation, the control unit 6 continues to be configured to simulate the movements that would occur if the effector unit 2 were mounted on a real carrier platform. This arrangement allows the laser weapon system to be tested for its reaction to disturbances, which are initiated by the movements of the carrier platform, under operating conditions. As an alternative, the base 7 can also be a real carrier platform, for example, a vehicle. In this case the control unit does not have to be configured to simulate the accelerations and/or the movements of the carrier platform, but rather the control unit is configured only to damp and/or to stabilize them.

The logic structure of the control unit 6 in simulation mode is shown in FIG. 2. In this case four programs are running on the control unit; and each program has a different task. The first program 101 serves to simulate the movements of a carrier platform, on which the effector unit 2 would be mounted under real conditions. Therefore, the output of the first program 101 is the control commands to the positioner unit 5 and these control commands correspond to the simulated movements. A second program 102 serves to stabilize the simulated movements of the carrier platform. In this case it is possible to test, for example, different control approaches that are to be used for the real operation of the effector unit 2. Therefore, the second program 102 also sends commands to the positioner unit 5, so that these commands conflict with the control commands of the first program 101, in order to stabilize the simulated movements. A third program 103 serves to detect and track a target. Therefore, the third program exchanges data with the recognition unit 4 and calculates, for example, the distance, the flight path and the direction to a recognized target. These data items are exchanged with a fourth program 104 that is responsible for pointing the effector unit 2 at the recognized target. As a result, the fourth program in turn sends control commands to the positioner unit 5. The continuous exchange of data between the third program 103 and the fourth program 104 allows the effector unit 2 to be adjusted on the basis of the flight path of the recognized target.

In summary, the first program 101 corresponds to a simulation model, whereas the second program 102, the third program 103 and the fourth program 104 correspond to the real system, so that these programs or at least components of these programs are used for the real system. Hence, the device 1 according to the invention ideally lends itself to testing these software components under simulated operating conditions.

In the special application of the device 1 the control unit 6 comprises three programs. This is shown in FIG. 3. In contrast to FIG. 2, the first program 101 is not used, so that the control unit 6 contains the second program 102, the third program 103 and the fourth program 104. Therefore, the control unit 6 can drive the positioner unit 5 in such a way that, on the one hand, the movements and/or the accelerations of the carrier platform are compensated for or at least damped; and, on the other hand, the effector unit is aimed at the target.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

LIST OF REFERENCE NUMERALS

1 device for testing and/or operating an effector unit
2 effector unit
3 laser beam
4 recognition unit
5 positioner unit
6 control unit
7 base
101 first program of the control unit
102 second program of the control unit
103 third program of the control unit
104 fourth program of the control unit

What is claimed is:

1. A device configured to aim and test laser weapon system for acting on a target, the device comprising:

an industrial robot configured to move the laser weapon system; and a controller configured to drive the industrial robot, wherein the controller is configured to drive the industrial robot to damp and to simulate accelerations and resulting velocities and movements of a carrier platform on which the device is intended to be mounted under operational conditions while the laser weapon system detects and tracks the target and aims at the detected and tracked target.

2. The device as claimed in claim 1, further comprising:

a camera for detecting the target.

3. The device as claimed in claim 1, wherein the industrial robot has at least three rotatory degrees of freedom or at least three translatory degrees of freedom.

4. The device as claimed in claim 1, wherein the controller is configured to control the industrial robot to compensate for real or simulated movements of the carrier platform.

5. A method for aiming and testing a laser weapon system for acting on a target by a device comprising an industrial robot configured to move the laser weapon system and a controller configured to drive the industrial robot, the method comprising:

detecting and tracking the target by the laser weapon system;

aiming the laser weapon system at the detected and tracked target, wherein while the target is detected and tracked and the laser weapon system is aimed, the method further comprises simulating movements of a carrier platform;

stabilizing the laser weapon system for the simulated movements of the carrier platform.

6. The method as claimed in claim 5, further comprising the steps:

performing a first action on the target and measuring an energetic effect of the first action using a first variant of at least one of (1) the detecting and tracking, (2) the aiming, (3) the simulating movements, and (4) the stabilization;

performing a second action on the target and measuring energetic effect of the second action using a second variant of at least one of (1) the detecting and tracking, (2) the aiming, (3) the simulating movements, and (4) the stabilization;

comparing the measurement of the first action with the measurement of the second action.

7. The method as claimed in claim 5, wherein a movement of the target is simulated by a target simulator.

* * * * *